US007686898B2

(12) United States Patent
Nazmy et al.

(10) Patent No.: US 7,686,898 B2
(45) Date of Patent: Mar. 30, 2010

(54) CREEP-RESISTANT MARAGING HEAT-TREATMENT STEEL

(75) Inventors: Mohamed Nazmy, Fislisbach (CH); Markus Staubli, Dottikon (CH); Andreas Kuenzler, Baden (CH)

(73) Assignee: Alstom Technology Ltd, Baden (CH)

( * ) Notice: Subject to any disclaimer, the term of this patent is extended or adjusted under 35 U.S.C. 154(b) by 322 days.

(21) Appl. No.: 11/741,130

(22) Filed: Apr. 27, 2007

(65) Prior Publication Data

US 2007/0193661 A1 Aug. 23, 2007

Related U.S. Application Data

(63) Continuation of application No. PCT/EP2005/055252, filed on Oct. 14, 2005.

(30) Foreign Application Priority Data

Oct. 29, 2004 (CH) ..... 1792/04

(51) Int. Cl.
*C22C 38/46* (2006.01)
*C22C 38/44* (2006.01)

(52) U.S. Cl. ..... 148/325; 148/326; 148/328; 148/335; 420/69; 420/109

(58) Field of Classification Search ..... 148/325, 148/326, 328, 335; 420/109, 69
See application file for complete search history.

(56) References Cited

U.S. PATENT DOCUMENTS

| | | | |
|---|---|---|---|
| 3,960,612 | A | 6/1976 | Kaku et al. |
| 4,946,516 | A | 8/1990 | Yano et al. |
| 5,061,325 | A | 10/1991 | Okamura et al. |
| 5,084,238 | A | 1/1992 | Masuyama et al. |
| 5,820,817 | A | 10/1998 | Angeliu et al. |
| 5,820,819 | A | 10/1998 | Tanabe et al. |
| 5,906,791 | A | 5/1999 | Angeliu |
| 6,030,469 | A | 2/2000 | Ernst et al. |
| 6,045,630 | A | 4/2000 | Fujiwara et al. |
| 6,248,187 | B1 | 6/2001 | Asahi et al. |
| 6,464,804 | B2 | 10/2002 | Goecmen et al. |
| 6,514,359 | B2 | 2/2003 | Kawano et al. |
| 2002/0003008 | A1 | 1/2002 | Goecmen et al. |

FOREIGN PATENT DOCUMENTS

| | | |
|---|---|---|
| DE | 198 32 430 | 2/1999 |

(Continued)

OTHER PUBLICATIONS

T.-U. Kern et al., "High temperature forged components for advanced steam power plants", 1998, pp. 53-61.

*Primary Examiner*—Deborah Yee
(74) *Attorney, Agent, or Firm*—Darby & Darby

(57) ABSTRACT

A maraging heat-treatment steel includes 8.5 to 9.5% by weight of Cr, 0.15 to 0.25% by weight of Mn, 2 to 2.7% by weight of Ni, 0.5 to 2.5% by weight of Mo, 0.4 to 0.8% by weight of V, 0.001 to 0.15% by weight of Si, 0.06 to 0.1% by weight of C, 0.11 to 0.15% by weight of N, 0.02 to 0.04% by weight of Nb, maximum 0.007% by weight of P, maximum 0.005% by weight of S, maximum 0.01% by weight of Al, iron and standard impurities, wherein a weight ratio of vanadium to nitrogen V/N is in a range between 4.3 and 5.5.

8 Claims, 1 Drawing Sheet

FOREIGN PATENT DOCUMENTS

| | | |
|---|---|---|
| EP | 0411515 | 2/1991 |
| EP | 0 758 025 | 2/1997 |
| EP | 0 866 145 | 9/1998 |
| EP | 0861915 | 9/1998 |
| EP | 0 931 845 | 7/1999 |
| EP | 1094126 | 4/2001 |
| EP | 1104816 | 6/2001 |
| EP | 1143026 | 10/2001 |
| EP | 1 158 067 | 11/2001 |
| GB | 1340744 | 1/1974 |
| JP | 08144012 | 6/1996 |
| JP | 08 225833 | 9/1996 |
| JP | 2001 098349 | 4/2001 |
| JP | 2001262273 | 9/2001 |
| WO | 0040764 | 7/2000 |

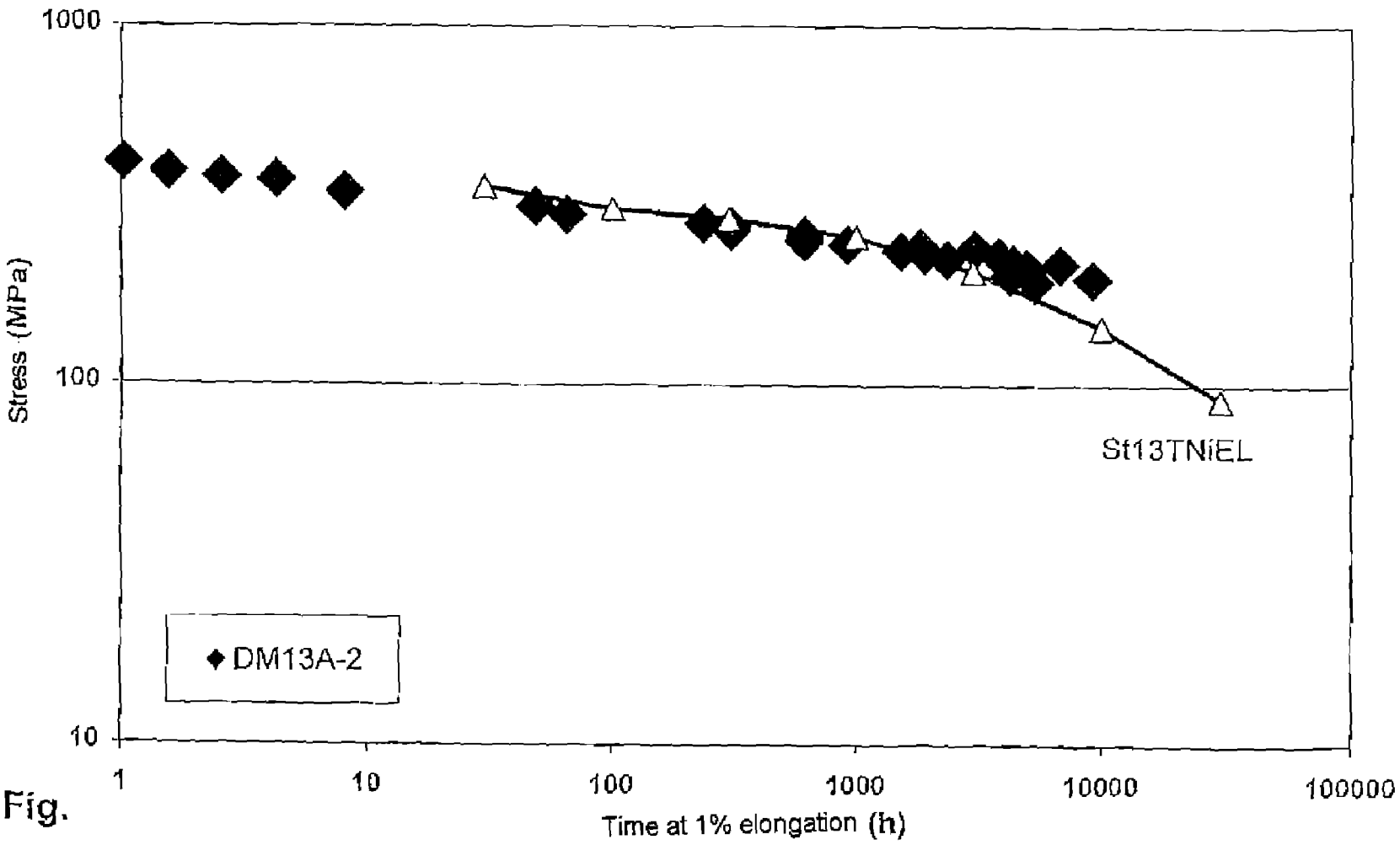
Fig.

CREEP-RESISTANT MARAGING HEAT-TREATMENT STEEL

This application is a continuation of International Patent Application No. PCT/EP2005/055252, filed on Oct. 14, 2005, which claims priority to Swiss Patent Application No. CH 01792/04, filed on Oct. 29, 2004. The entire disclosure of both applications is incorporated by reference herein.

The present invention relates to maraging steels with high nitrogen contents, which are distinguished by a very good combination of properties, in particular by a high resistance to creep and a good ductility.

BACKGROUND

Maraging steels based on 9-12% chromium are materials that are in widespread use in power plant engineering. It is known that adding chromium within the abovementioned range allows not only a good resistance to atmospheric corrosion but also full hardening all the way through thick-walled forgings (as used for example as monoblock rotors or as rotor disks in gas and steam turbines) to be achieved. Tried-and-tested alloys of this type usually contain approximately 0.08 to 0.2% carbon, which in solution allows a hard martensitic structure to be established. A good combination of hot strength and ductility in martensitic steels is made possible to a tempering treatment, in which the precipitation of carbon in the form of carbides with simultaneous annealing of the dislocation substructure leads to the formation of a particle-stabilized subgrain structure. The tempering performance and the resulting properties can be effectively influenced by the choice and quantitative adjustment of special carbide-forming agents, such as for example Mo, W, V, Nb and Ta.

Strengths of over 850 MPa can be established in 9-12% chromium steels by keeping the tempering temperature at a low level, typically in the range from 600 to 650° C. However, the use of low tempering temperatures leads to high transition temperatures from the brittle to ductile state (over 0° C.), with the result that the material has brittle fracture properties at room temperature. Significantly improved ductilities can be achieved if the heat-treated strength is reduced to below 700 MPa. This is achieved by raising the tempering temperature to over 700° C. The use of higher tempering temperatures has the advantage that the microstructural states which are established have long-term stability at elevated temperatures. A typical representative which is in widespread use in steam power plants, in particular as rotor steel, is the DIN steel X20CrMoV12.1.

It is also known that the ductility can be significantly improved at a strength level of 850 MPa by the addition of nickel to the alloy. For example, it is known that by adding approximately 2 to 3% nickel to the alloy, the transition temperature from the brittle to ductile state is still below 0° C. even after a tempering treatment at temperatures of from 600 to 650° C., with the result that overall a significantly improved combination of strength and ductility can be established. Therefore, alloys of this type are in widespread use where significantly higher demands are imposed on both strength and ductility, typically as disk materials for gas turbine rotors. A typical representative of alloys of this type, which is in widespread use in gas turbine engineering, in particular as a material for rotor disks, is the DIN steel X12CrNiMo12.

In recent times, various efforts have been made to improve specific properties of these steels. For example, the publication by Kern et al.: High Temperature Forged Components for Advanced Steam Power Plants, in Materials for Advanced Power Engineering 1998, Proceedings of the 6th Liège Conference, ed. by J. Lecomte-Becker et. al., describes the development of new types of rotor steels for steamturbine applications. In alloys of this type, the Cr, Mo, W contents were optimized further taking account of the parameters of approximately 0.03 to 0.07% N, 0.03 to 0.07% Nb and/or 50 to 100 ppm B, in order to improve the creep resistance and creep rupture strength for applications at 600° C.

On the other hand, specifically for gas turbine applications, efforts have been made to either improve the creep rupture strengths in the range from 450 to 500° C. at a high ductility level or to reduce the susceptibility to embrittlement at temperatures between 425 and 500° C. For example, European Patent application EP 0 931 845 A1 describes a nickel-containing 12% chromium steel, the constitution of which is similar to DIN steel X12CrNiMo12 and in which the level of molybdenum has been reduced compared to the known steel X12CrNiMo12, but a higher tungsten content has been added. DE 198 32 430 A1 discloses a further optimization to a steel of similar type to X12CrNiMo12, designated M152, in which the susceptibility to embrittlement in the temperature range between 425 and 500° C. is restricted by the addition of rare earth elements.

One possible approach for improving the hot strength combined, at the same time, with a high ductility was proposed by the development of steels with high nitrogen contents. EP 0 866 145 A2 describes a new class of martensitic chromium steels with nitrogen contents in the range between 0.12 and 0.25%. In this class of steels, the overall microstructure formation is controlled by the formation of special nitrides, in particular vanadium nitrides, which can be distributed in numerous ways by means of the forging treatment, by austenitization, by a controlled cooling treatment or by a tempering treatment. Whereas the strength is achieved by the hardening action of the nitrides, the patent application in question aims to establish a high ductility by means of the distribution and morphology of the nitrides, but in particular by limiting the grain coarsening during forging and during the solutionizing treatment. In said document, this is achieved by both a high volumetric level and a high particle coarsening resistance of nitrides of low solubility, so that a dense dispersion of nitrides was still able to effectively restrict grain growth even at austenization temperatures of 1150 to 1200° C. The main benefit of the alloys mentioned in EP 0 866 145 A2 is the possibility of optimizing the combination of strength and ductility simply by the distribution and morphology of nitrides, on the basis of a suitable definition of the heat treatment.

However, an optimized nitride state is only one factor in achieving a maximum ductility. A further influencing factor is likely to arise from the effect of dissolved substitution elements, such as nickel and manganese. Within the class of carbon steels, it is known that manganese tends to have an embrittling rather than ductility-enhancing effect. In particular, it causes embrittlement if the alloy is exposed to prolonged annealing at temperatures in the range from 350 to 500° C. It is also known that nickel in carbon steels improves the ductility but also tends to reduce the hot strength at high temperatures. This is related to a reduced carbide stability in nickel-containing steels.

EP 1 158 067 A1 has disclosed a maraging heat-treatment steel having the following chemical composition (details in % by weight): 9 to 12 Cr, 0.001 to 0.25 Mn, 2 to 7 Ni, 0.001 to 8 Co, at least one of W and Mo in total between 0.5 and 4, 0.5 to 0.8, at least one of Nb, Ta, Zr Hf in total between 0.001 to 0.1, 0.001 to 0.05 Ti, 0.001 to 0.15 Si, 0.01 to 0.1 C, 0.12 to 0.18 N, max. 0.025 P, max. 0.015 S, max. 0.01 Al, max. 0.0012 Sb, max. 0.007 Sn, max. 0.012 As, remainder Fe and standard impurities, with the proviso that the vanadium to nitrogen weight ratio V/N is in the range between 3.5 and 4.2. These alloys are distinguished by a very good combination of notched-impact energy at room temperature and hot strength at 550° C., in particular even with relatively high Cr contents. The relatively high N content increases the creep rupture strength. Within the range stipulated, V and N are in virtually stoichiometric proportions. This results in an optimum solubility and resistance to coarsening on the part of the vanadium nitrides. The high solubility is required in order for the maximum possible amount of the precipitation-hardening vanadium nitride to be dissolved, while a high resistance to nitride coarsening is needed in order to be able to achieve a structure which is as fine-grained as possible during the heat treatment described in EP 1 158 067 A1.

It is known that in steels containing approx. 12% chromium and with a high N content, the α'Cr phase disadvantageously precipitates in the temperature range from approximately 425 to 500° C., which leads to embrittlement of the steel. Although these precipitations increase the strength properties, they reduce the ductility, notched impact strength and corrosion resistance. Consequently, steels of this type are of only limited use in compressors or turbines in the power plant sector. The formation of VN in steels of this type also increases the susceptibility to precipitation of the α'Cr phase and therefore the susceptibility to embrittlement within the temperature range mentioned.

SUMMARY OF THE INVENTION

An object of the present invention is to provide a maraging heat-treatment steel with a high ductility in the temperature range between 350 and 500° C. and a good creep resistance in the temperature range up to 550° C.

The present invention provides a maraging heat-treatment steel, having the following composition (details in % by weight): 8.5 to 9.5 Cr, 0.15 to 0.25 Mn, 2 to 2.7 Ni, 0.5 to 2.5 Mo, 0.4 to 0.8 V, 0.02 to 0.04 Nb, 0.001 to 0.15 Si, 0.06 to 0.1 C, 0.11 to 0.15 N, max 0.007 P, max 0.005 S, max 0.01 Al, remainder iron and standard impurities, with the proviso that the vanadium to nitrogen weight ratio V/N is in the range between 4.3 and 5.5.

Preferred ranges for the individual alloying elements in the composition according to the invention are given in the claims.

The abovementioned alloy establishes a good heat-treatment microstructure distinguished by a ductile base matrix and by the presence of nitrides which impart hot strength, while at the same time the susceptibility to embrittlement in the range between 350 and 500° C. is suppressed. The ductility of the base matrix is established by the presence of substitution elements, preferably by nickel. The contents of the substitution elements are set in such a way as to allow optimization of both the maraging (martensitic hardening) and the particle hardening by means of special nitrides, preferably vanadium nitrides, in order to establish a high creep rupture strength combined, at the same time, with a good ductility. The susceptibility of the steel according to the invention to embrittlement in the temperature range from 350 to 500° C. as a result of the precipitation of the α'Cr phase is suppressed by the moderate N content and by the Cr content being low compared to the known prior art.

The text which follows outlines the preferred quantities, in percent by weight, for each element, as well as the reasons for the alloying ranges according to the invention which have been selected, in conjunction with the resulting heat treatment options.

Chromium:

A chromium content of 8.5 to 9.5% by weight allows an acceptable full-hardenability of thick-walled components to be achieved and ensures sufficient resistance to oxidation up to a temperature of 550° C. Using less than 8.5% by weight has an adverse effect on the ability to achieve full hardening. Levels above 9.5% lead to accelerated formation of the α'Cr phase during the tempering operation, which leads to embrittlement of the material.

Manganese And Silicon:

These elements promote tempering embrittlement and therefore have to be restricted to the least possible levels. The range to be specified should, taking account of the ladle metallurgy possibilities, be in the range between 0.15 and 0.25% for manganese and between 0.001 and 0.15% for silicon.

Nickel:

Nickel is used as an austenite-stabilizing element in order to suppress delta-ferrite. Furthermore, as a dissolved element in the ferrite matrix, it is supposed to improve ductility. Nickel contents between 2 and 2.7% by weight are optimum, since on the one hand the nickel is homogenously dissolved in the matrix, but on the other hand there is not yet an increased level of retained austenite or tempered austenite in the heat-treated martensite.

Molybdenum:

This element improves the creep resistance by solid-solution hardening as a partially dissolved element and by precipitation hardening during long-term stress. An excessive level of this element, however, leads to embrittlement during long-term age hardening, which results from the precipitation and coarsening of the sigma phase. For this reason, the maximum Mo content must be restricted to 2.5%. A preferred range is approx. 1.4 to 1.6%.

Vanadium And Nitrogen:

These two elements together play a crucial role in determining the grain size formation and the precipitation hardening. The microstructural forms are optimum if the elements vanadium and nitrogen are added to the alloy in a slightly superstoichiometric V/N ratio. A slightly super stoichiometric ratio also increases the stability of vanadium nitride compared to that of chromium nitride. Overall, a V/N ratio in the range between 4.3 and 5.5 is preferred. The specific level of nitrogen and vanadium nitrides depends on the optimum volumetric content of the vanadium nitrides, which should remain in the form of insoluble primary nitrides during the solutionizing. The higher the overall vanadium and nitrogen content, the greater the proportion of the vanadium nitrides which is no longer dissolved, and the greater the grain refining action. The positive influence of the grain refining on the ductility is, however, limited, since as the volumetric level of primary nitrides increases, the primary nitrides themselves restrict ductility. Since Vn also increases the susceptibility to the formation of the brittle α'Cr phase, the preferred nitrogen content should be in the range from 0.11 to 0.12% by weight, and the preferred vanadium content should be in the range between 0.5 and 0.6% by weight. Ranges from 0.11 to 0.15% by weight for N and 0.4-0.8% by weight V are conceivable.

Niobium:

As well as vanadium, niobium is a preferred element among the special nitride-forming elements. The preferred range is 0.02 to 0.04% by weight. When added in these low levels, the resistance to grain coarsening during solutionizing is increased, and the stability of primary and precipitating V8N,C)-nitrides is increased by partial substitution of V.

Phosphorus And Sulfur:

These elements, together with silicon and manganese, increase the tempering embrittlement during long-term age hardening in the range between 350 and 500° C. Therefore, these elements should be restricted to the minimum levels that can be tolerated.

Aluminum:

This element is a strong nitride-forming element, which bonds with nitrogen even in the melt, and therefore greatly impairs the efficacy of the nitrogen added to the alloy. The aluminum nitrides formed in the melt are very coarse and reduce the ductility. Therefore, aluminum should be limited to a content of at most 0.01% by weight.

Carbon:

Carbon forms chromium carbides during tempering, which promote an improved creep resistance. However, if the carbon contents are too high, the resulting high volumetric carbide content leads to a reduction in ductility, which takes effect in particular through carbide coarsening during long-term age hardening. Consequently, the upper limit for the carbon content should be restricted to 0.1%. The fact that carbon increases surface hardening during welding is a further drawback. The particularly preferred carbon content is in the range between 0.06 and 0.8% by weight.

BRIEF DESCRIPTION OF THE DRAWING

The drawing illustrates an exemplary embodiment of the invention. The only FIGURE shows the way in which the stress is dependent on time to achieve a creep elongation of 1% at 550° C. for an alloy according to the invention and an alloy known from the prior art.

DETAILED DESCRIPTION

In the text which follows, the invention is explained in more detail on the basis of exemplary embodiments and FIG. 1.

Table 1 shows the chemical composition (in % by weight) of a preferred alloy according to the invention (DM13) and of comparison alloys:

TABLE 1

| | Chemical composition | | |
|---|---|---|---|
| | DM13A-2 | St13TNiEL | Alloy type "D" |
| C | 0.08 | 0.12 | 0.04 |
| Cr | 9.0 | 11.5 | 11.2 |
| Mn | 0.19 | Max. 0.25 | 0.05 |
| Ni | 2.4 | 2.3 | 3.06 |
| Co | | | 4.02 |
| Mo | 1.4 | 1.5 | 1.83 |
| V | 0.6 | 0.25 | 0.61 |
| Nb | 0.04 | | 0.03 |
| Si | 0.13 | 0.25 | <0.02 |
| N | 0.117 | 0.035 | 0.156 |
| Al | 0.008 | | <0.02 |

TABLE 1-continued

| | Chemical composition | | |
|---|---|---|---|
| | DM13A-2 | St13TNiEL | Alloy type "D" |
| P | | Max. 0.025 | 0.004 |
| S | | Max. 0.015 | 0.002 |
| V/N | 5.13 | 7.24 | 3.91 |

10 kg melts were melted in an induction furnace, and then forged flat bars with dimensions of 20 mm×80 mm were produced. The following heat treatments were carried out:

DM13A-2:

1100° C./3 h/rapid air cooling (fan)+640° C./5 h/air cooling

St13TNiEL:

1050-1080° C./>0.5 h/oil+630-650° C./2h/air cooling

Alloy "D":

1180°/2 h/air cooling+640° C./2 h/air cooling+600° C./1 h/furnace cooling

Table 2 gives experimental data for determining the notched impact energy at room temperature:

TABLE 2

Notched-impact energy for various alloys treated in different ways

| Alloy | Conditions | Notched-impact energy in J |
|---|---|---|
| DM13A-2 | Starting state after above heat treatment | 76 |
| | Age-hardened at 400° C./1032 h | 90 |
| | Age-hardened at 480° C./1032 h | 58 |
| St13TNiEL | Starting state after above heat treatment | >40 (required) |
| Alloy "D" | Starting state after above heat treatment | 106 |
| | Age-hardened at 300° C./5000 h | 57 |
| | Age-hardened at 380° C./5000 h | 36 |
| | Age-hardened at 450° C./5000 h | 21 |
| | Age-hardened at 500° C./5000 h | 54 |

The reduction in the notched-impact energy in alloy "D" after age-hardening of the specimens in the range between 300 and 500° C. is clearly apparent. The reason for this is the precipitation of the α'Cr phase. In the alloy according to the invention DM13A-2, by contrast, the susceptibility to precipitation of this phase is reduced, and consequently the embrittlement is also lower within the temperature range specified.

Tensile tests at room temperature and at 550° C. on the heat-treated specimens described above (starting state) yielded the results given in Table 3:

TABLE 3

Tensile tests at room temperature and at 550° C. on the heat-treated specimens described above.

| Alloy | T in ° C. | Yield strength in MPa | Tensile strength in MPa | Elongation in % | Local reduction in area in % | Modulus of elasticity in GPa |
|---|---|---|---|---|---|---|
| DM13A-2 | 20 | 928 | 1036 | 14.4 | 64 | 212 |
| | 550 | 600 | 637 | 19.9 | 75.3 | 155 |
| St13TNiEL | 20 | 852 | 985 | | | |
| | 550 | 470 | 530 | | | |
| Alloy "D" | 20 | 975 | 1068 | 15.2 | 67 | |
| | 550 | 714 | 750 | 15.0 | 72 | |

The alloy according to the invention is distinguished both by a high hot strength at 500° C. and by a high ductility and a good modulus of elasticity.

The only figure illustrates the stress for 1% creep elongation at 550° C. as a function of time for alloys DM13A-2 and St13TNiEL. The advantage of the alloy according to the invention manifests itself at high age-hardening times.

Of course, the invention is not restricted to the exemplary embodiment described.

What is claimed is:

1. A maraging heat-treatment steel, consisting of:

8.5 to 9.5% by weight of Cr;

0.15 to 0.25% by weight of Mn;

2 to 2.7% by weight of Ni;

0.5 to 2.5% by weight of Mo;

0.4 to 0.8% by weight of V;

0.001 to 0.15% by weight of Si;

0.06 to 0.1% by weight of C;

0.11 to 0.15% by weight of N;

0.02 to 0.04% by weight of Nb;

maximum 0.007% by weight of P;

maximum 0.005% by weight of S;

maximum 0.01% by weight of Al; and remainder iron and standard impurities, wherein a weight ratio of vanadium to nitrogen V/N is in a range between 4.3 and 5.5.

2. The maraging heat-treatment steel as recited in claim 1, wherein the Cr is 8.5 to 9% by weight.

3. The maraging heat-treatment steel as recited in claim 1, wherein the Mn is 0.2% by weight.

4. The maraging heat-treatment steel as recited in claim 1, wherein the Ni is 2.3 to 2.6% by weight.

5. The maraging heat-treatment steel as recited in claim 1, wherein the Mo is 1.4 to 1.6% by weight.

6. The maraging heat-treatment steel as recited in claim 1, wherein the V is 0.5 to 0.6% by weight.

7. The maraging heat-treatment steel as recited in claim 1, wherein the N is 0.11 to 0.12% by weight.

8. The maraging heat-treatment steel as recited in claim 1, wherein the C is 0.06 to 0.08% by weight.

* * * * *